US006055943A

United States Patent [19]

Cochrane et al.

[11] Patent Number: 6,055,943

[45] Date of Patent: May 2, 2000

[54] AIR PORT CASTING

[75] Inventors: Steven M. Cochrane, Portland; Kenneth A. Pingel, Hillsboro, both of Oreg.

[73] Assignee: Anthony-Ross Company, Beaverton, Oreg.

[21] Appl. No.: 09/157,789

[22] Filed: Sep. 21, 1998

Related U.S. Application Data

[60] Provisional application No. 60/060,035, Sep. 25, 1997.

[51] Int. Cl.[7] ..... F22B 37/06

[52] U.S. Cl. ..... 122/6.5; 110/182.5

[58] Field of Search ..... 122/5.51, 6.5, 122/6 B, DIG. 7; 110/182.5

[56] References Cited

U.S. PATENT DOCUMENTS

| | | | |
|---|---|---|---|
| 3,742,916 | 7/1973 | Wessberg et al. | 110/182.5 |
| 4,940,004 | 7/1990 | Jansen | 122/6.5 |
| 5,001,992 | 3/1991 | Higgins et al. | 110/182.5 |
| 5,044,327 | 9/1991 | Hunt | 122/6.5 |
| 5,307,745 | 5/1994 | Higgins et al. | 110/182.5 |
| 5,528,999 | 6/1996 | Salmi | 110/182.5 |

*Primary Examiner*—Denise L. Ferensic
*Assistant Examiner*—Gregory A. Wilson
*Attorney, Agent, or Firm*—Dellett and Walters

[57] ABSTRACT

Improved air port castings are employed in a recovery boiler, eliminating the use of a crotch plate in a membrane/tube type boiler. The casting extends over the exposed portion where the membrane begins again at an air port, providing a sacrificial member that is replaceable. An upper mounting bolt is employed, but no lower bolt is required, making replacement of the casting simpler. A damper guide is formed as an integral portion of the air port casting.

18 Claims, 4 Drawing Sheets

AIR PORT CASTING

This application claims priority under 35 U.S.C. 119(e) of U.S. Provisional Patent Application No. 60/060,035, filed Sep. 25, 1997.

This invention relates to recovery boilers and the like and more particularly to an improved air port casting for use in conjunction with the air ports of a chemical recovery boiler.

BACKGROUND OF THE INVENTION

Recovery boilers, also called recovery furnaces, are used to reclaim chemicals used in, for example, the paper making process. The boiler is surrounded by a series of cooling tubes, which are occasionally separated to define an air port into the body of the boiler, for introduction of air to assist in the combustion taking place in the center of the boiler. Normally there are three principal air port types, primary, secondary and tertiary air ports (although there can be others, as some recovery boilers have quarternary air ports, for example). The primary air ports are typically smaller and are more numerous, disposed on the walls of the furnace firebox near the bottom of the furnace. Air supplied to the primary ports is at a relatively low pressure, and provides combustion air primarily to the perimeter of the char bed in the interior of the furnace. Adjustment of the primary air port air allows control of the shape and position of the char bed's perimeter. Secondary air ports are typically larger and fewer in number than primary air ports, and are usually placed around the walls of the firebox higher up than the primary air ports, but below the liquor spray nozzles that spray in the fuel, called liquor, to be evaporated, gasified, pyrolized, oxidized and reduced. Air through the secondary ports is normally at a higher pressure than is the primary air and is used to control the position of the top of the char bed as well as to aid in combustion of gasses rising from the char bed. Tertiary air ports are located above the liquor spray nozzles and are generally fewer in number than secondary air ports, and usually employ a still higher pressure air to promote combustion and mixing of gasses rising in the firebox.

For use in conjunction with the air ports of some style boilers, air port castings have been developed, to define the frame of the opening of the air port, as well as providing some protection to the tubes against damage by any automatic port rodding devices or by manual port rodding, since the ports must frequently be freed of any built up excrescent material by rodding, repeated insertion of a cleaning rod into the air port for dislodging of built up material, to ensure adequate air flow into the boiler. Other boiler styles employ a nozzle that may be welded directly to the tubes around the air port opening, to provide protection against rodding and perhaps a more directed flow of air into the boiler.

In addition to the casting/nozzle distinction at the air ports, there are two predominant style of recovery boiler tube designs, those employing adjacent cooling tubes 10 (which may be, for example, three inches in diameter) with a membrane 12 (which may be one inch wide, for example) between adjacent tubes (see FIG. 1) or so called tangent tube designs, wherein, for example, the tubes are two inch diameter and are one thirty-second of an inch apart. In this tangent tube design, for example, as manufactured by Combustion Engineering until the late 1960s, the tubes are welded together, the weld occupying the 1/32nd inch space. Other examples of tangent tube designs exist, with 3 inch tubes on 3 inch centers, by Babcock and Wilcox (until late 1960s) and by Gotaverken (manufactured until 1991).

To form the air port with the membrane style boiler, which can be a boiler manufactured by Combustion Engineering (after 1967), for example, referring to FIG. 1, the membrane 12*a*, 12*b* is eliminated at either "outer" side 14, 16 of two adjacent tubes 10*a*, 10*b* and the tubes are bent outwardly and away from each other, to form an opening 18 which defines the air port. In nozzle design boilers, as the tubes flare outwardly, the membrane widens, up to two inches wide at 20, and then ends, forming a crotch plate 22, the area of transition from one inch membrane to two inch width port opening. Because of thermal stress and heat transfer problems, the membrane is restricted to about a one inch maximum width on newer boilers, otherwise, the membrane will corrode, or even worse, will develop a crack. On older boilers, a membrane up to 2 inches wide was often used. Because of this width, the crotch plate does not get enough cooling and tends to develop corrosion. Also, because of its location at the interior of the boiler, the crotch plates on primary level ports are potentially subject to contact by the smelt bed, resulting in even more severe thermal gradients and further corrosion. Therefore, the crotch plate is a potential failure zone; if a crack develops at the crotch plate, there is a risk that the crack will migrate to one of the adjacent tubes, which are welded to the membrane, potentially allowing cooling water to escape. In such a case, there may be a smelt-water reaction between the cooling water in the tubes and the molten smelt in the recovery boiler. The resulting explosion can kill or injure nearby workers, as well as potentially destroying the recovery boiler. Therefore, the crotch plate is carefully inspected from the interior of the furnace during shut down and any cracks located are ground down and the membrane or crotch plate is repaired. The required grinding raises further issues, since whenever grinding is performed near a tube, there is a risk of nicking the tube. If the tube is nicked, it then must be repaired by certified welders, including being x-rayed to inspect for damage, adding to the repair expense. In general, it is very costly and time consuming to make the required inspections and repairs, such inspection and repair often being the critical path of shut down, determining how long the shut down will last.

The welded nozzle boiler designs are difficult to maintain, since any maintenance or changes at the nozzles run into the potential for nicking or otherwise damaging the cooling tubes with the corrective actions required as noted above. Also, cracks in the crotch plate may be concealed by the nozzle or its weldment.

It is desirable to install a port damper assembly (see, for example U.S. Pat. No 5,307,745, entitled REMOVABLE DAMPER FOR CHEMICAL RECOVERY FURNACE) to allow selective adjustment of the size of the opening of the air port, to alter the pressure or volume of air flowing into the boiler. Installing a port damper assembly, and raising the air pressure in the windbox, can help reduce the situation where the smelt bed in the interior of the recovery boiler moves and contacts the tubes (or membrane in that style of boiler). The windbox is a duct or other sealed chamber that is pressurized to force air into the furnace through the air ports. However, in order to install a port damper assembly, heretofore, it has been necessary to install a damper guide along the length of the air port and/or extending above it, to provide a flat guide for the guillotine style damper as it is raised up away from the air port. Also, it is necessary to provide a flat surface at the face of the casting in boilers of such design, to operate as a sealing surface for the damper. Modern castings are curved because of the out-of-plane tube bends used to define the air port. Therefore, modification of the furnace air port area is required. A flat built up area is added, but due to limited space, the flat surface is typically relatively far away from the air port opening (there is not room close to the port to provide the structure for the flat surface, and, the windbox may be such that there is not sufficient space above the air port to accommodate the vertical travel of the port damper assembly). Thus, the damper is moved farther back away from the air port opening where there is more room, reducing the effectiveness of the damper. To maximize damper effectiveness, the damper should operate as close as possible to the tube opening so the air jet expansion/dissipation occurs after (not prior to) exiting the port opening. The above noted modifications add to the concerns and expense of mounting air port damper assemblies, and the modifications to provide the flat surface add more repair consideration which must be handled. In order to remove and replace the port casting, it becomes necessary to dismantle the damper guide, as the damper guide mounting hardware or the guide itself would not need to be replaced but may restrict access to the bolts holding the port casting to the boiler, further complicating the maintenance procedures.

In prior out-of-plane air port casting assemblies, mounting of the casting to the port is accomplished by upper, lower, left and right bolts which are mounted (e.g. welded) to the outer side of a junction (typically to the membrane) between two adjacent cooling tubes above, below, to the left and to the right of the air port. After the casting is positioned and tightened down on the bolts, a refractory material is applied around the lower bolt area, to provide protection against the harsh environment in which the lower bolt and windbox exist. Since the refractory material hardens to a cement like consistency, later removal of the casting is difficult, presenting the so called "bottom bolt" problem, as the refractory material must be chiseled away and the threads and nut securing the casting are likely damaged, further complicating removal. Also, the threads of the other mounting bolts can be damaged, sometimes requiring that the bolts be cut off in order to remove the casting.

SUMMARY OF THE INVENTION

According to an embodiment of the invention, an air port casting is provided with a damper guide assembly as an integral part thereof, so that an air port damper may ride up and down thereon, enabling adjustment of the size of the air port opening. The air port casting has a flat back region, that together with its integral damper guide provides a planar region for the damper to travel on. An embodiment of the air port casting is suitably employed in replacing the crotch plate and welded nozzle assembly of inter-tube membrane type recovery boilers. The air port casting according to the invention is mounted without a bottom bolt, eliminating the bottom bolt problem.

It is therefore an object of the invention to provide an improved air port casting that furnishes a flat back for accommodating a damper thereagainst.

It is another object of the invention to provide an improved air port casting that replaces the crotch plate as much as possible.

It is a further object of the invention to provide an improved air port casting system that reduces the number of mounting studs required to secure the casting to the boiler.

It is yet another object of the invention to provide an improved air port casting that also acts as a guide rack for a port damper assembly.

It is a further object of the present invention to provide an improved mounting method for air port castings that reduces the required mounting studs by one half.

It is still a further object of the present invention to provide an improved air port casting that avoids the bottom bolt problem.

It is another object of the invention to provide an improved air port casting that enables easier and less expensive maintenance procedures.

Yet another object of the invention is to provide an improved air port casting with a flat back surface for enabling a damper to rest thereagainst when closed and including a further guide against which the damper may rest when in an opened position.

Another object of the present invention is to provide an improved method of employing an air port casting on a boiler not designed for using castings.

An object of the invention is also to provide an improved method that replaces the crotch plate in a recovery boiler.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 3:
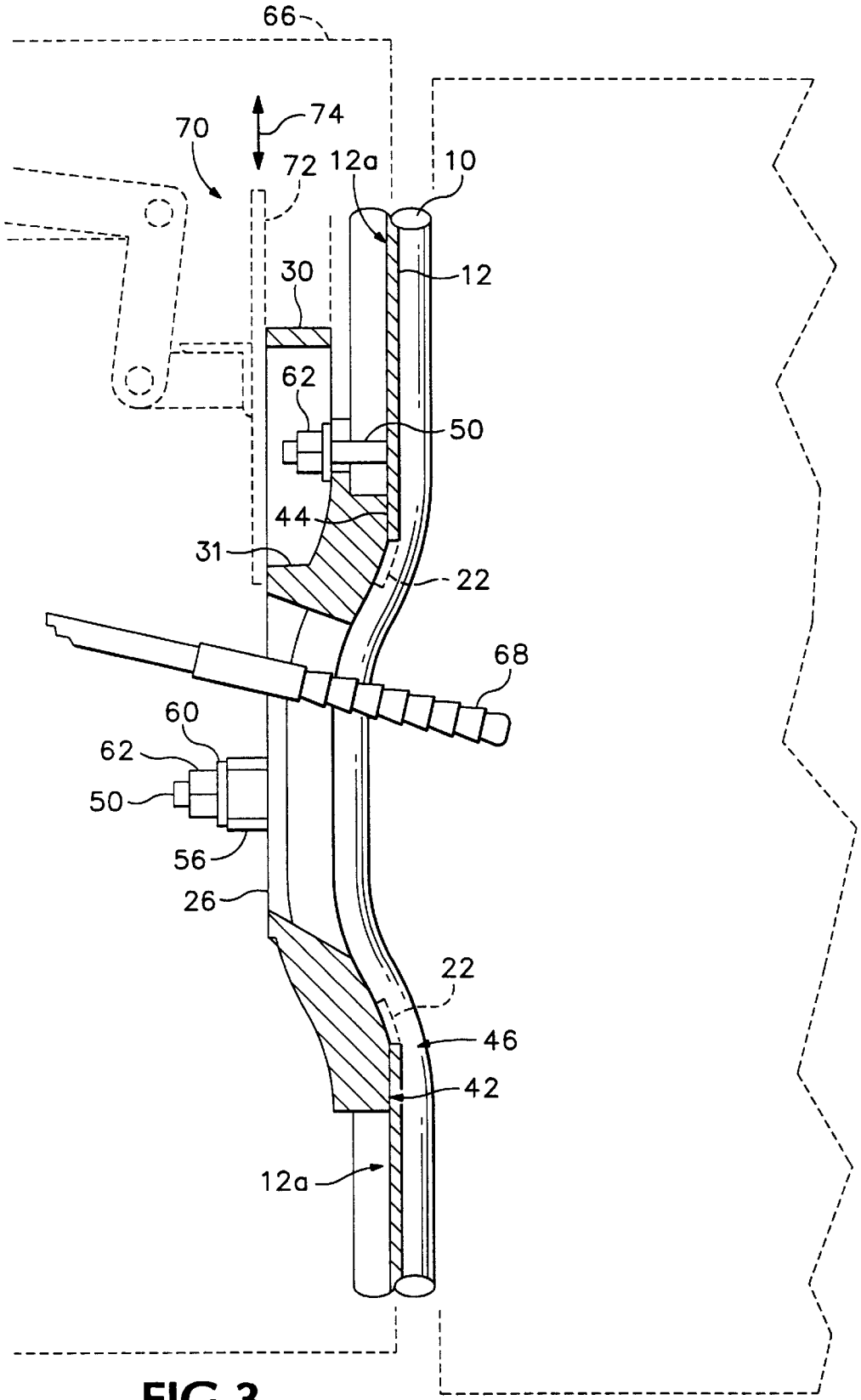
FIG. 3 is a side sectional view of a cut away portion of a recovery boiler, taken along line 3—3 of FIG. 1, illustrating mounting of an air port casting thereon, wherein a cleaning rod is introduced into the air port.
Figure 5:
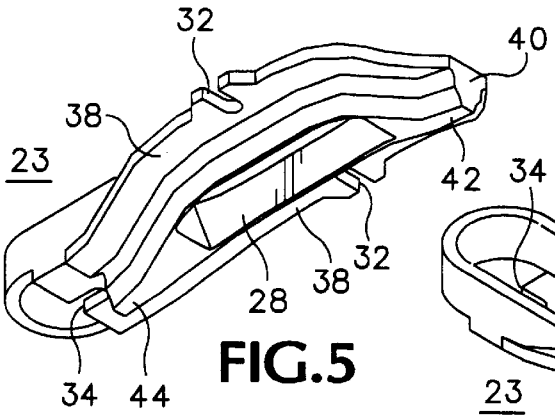
FIG. 5 is a perspective view of the inside face of the air port casting.
Figure 4:
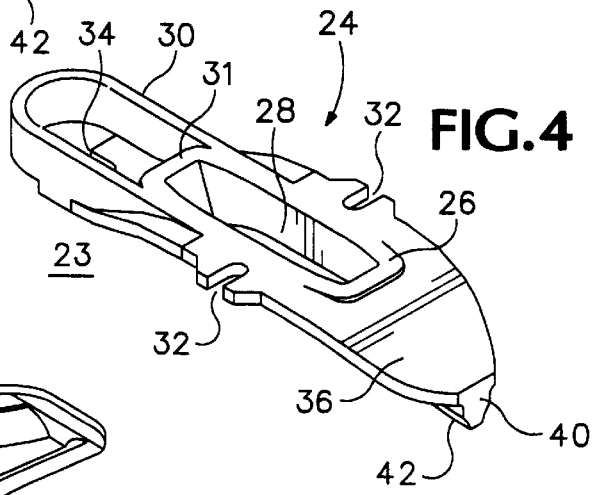
FIG. 4 is a perspective view of the outside face of the air port casting.

Referring now to FIG. 4 and FIG. 5, perspective views of the outside face and inside face, respectively, of the air port casting 23 according to a preferred embodiment of the invention, the casting comprises outside face 24, which has an approximately rectangular through opening 28 defined in the central portion thereof, corresponding to the air port of the recovery boiler. Defined about the perimeter of opening 28 is a central flat rim 26, which is substantially planar, to provide a flat sealing rim about the outer edge of opening 28. At an upper end of the air port casting, a damper guide member 30 is provided, wherein the upper edge of the guide member defines a surface that is co-planar with the central flat rim 26. The flat rim 26 and damper guide member 30 thereby generate a flat perimeter upon which a damper may ride, as discussed in conjunction with FIG. 3 hereinbelow. Damper guide 30, in the illustrated embodiment, has left and right edge portions spaced apart from each other which extend some distance beyond the rest of the body of the air port casting, and have a closed, upside down U configuration at the top thereof. An alternative damper guide comprises a single member, for example placed along the vertical center line of the port casting. At the bottom of the guide 30 above opening 28, a stop member 31 extends across the top of the opening, and thereby defines a stop to prevent air from traveling over the top of a damper blade and into the air port at the top of the casting (see FIG. 3). Approximately centrally of the air port casting, at the left and right edges thereof, mounting slots 32 are defined, for receiving mounting pins therein when securing the casting to an air port, as will be described herein. An upper mounting slot 34 is defined at an upper flange end of the air port casting, in the region of guide member 30, to receive an upper mounting bolt therein. Lower flange region 36 is flared downwardly away from the plane of rim 26. It should be noted that no lower bolt receiving slot is required in accordance with the air port casting of the present invention.

Referring now to FIG. 5, which is an opposite side view of the air port casting of FIG. 4, left and right tube engaging flanges 38 provide a form fitting surface of a shape that conforms to the bends of the tubes that define the air port perimeter. The flanges are flat or membrane like and are the material in which mounting slots 32 are defined. Centered about a longitudinal center line of the air port casting is casting body member 40, which slopes up from flanges 38, to further define a surface that conforms to the shapes of the tubes about the air port opening. Member 40 is thickest along the center of the air port casting and along the perimeter of the opening 28. Lower membrane contact pad 42 and upper membrane contact pad 44 are defined at the upper and lower extent of air port casting body member 40, and provide surfaces which rest against outer faces of the crotch plate and cooling tube membrane, as further described hereinbelow.

Figure 1:
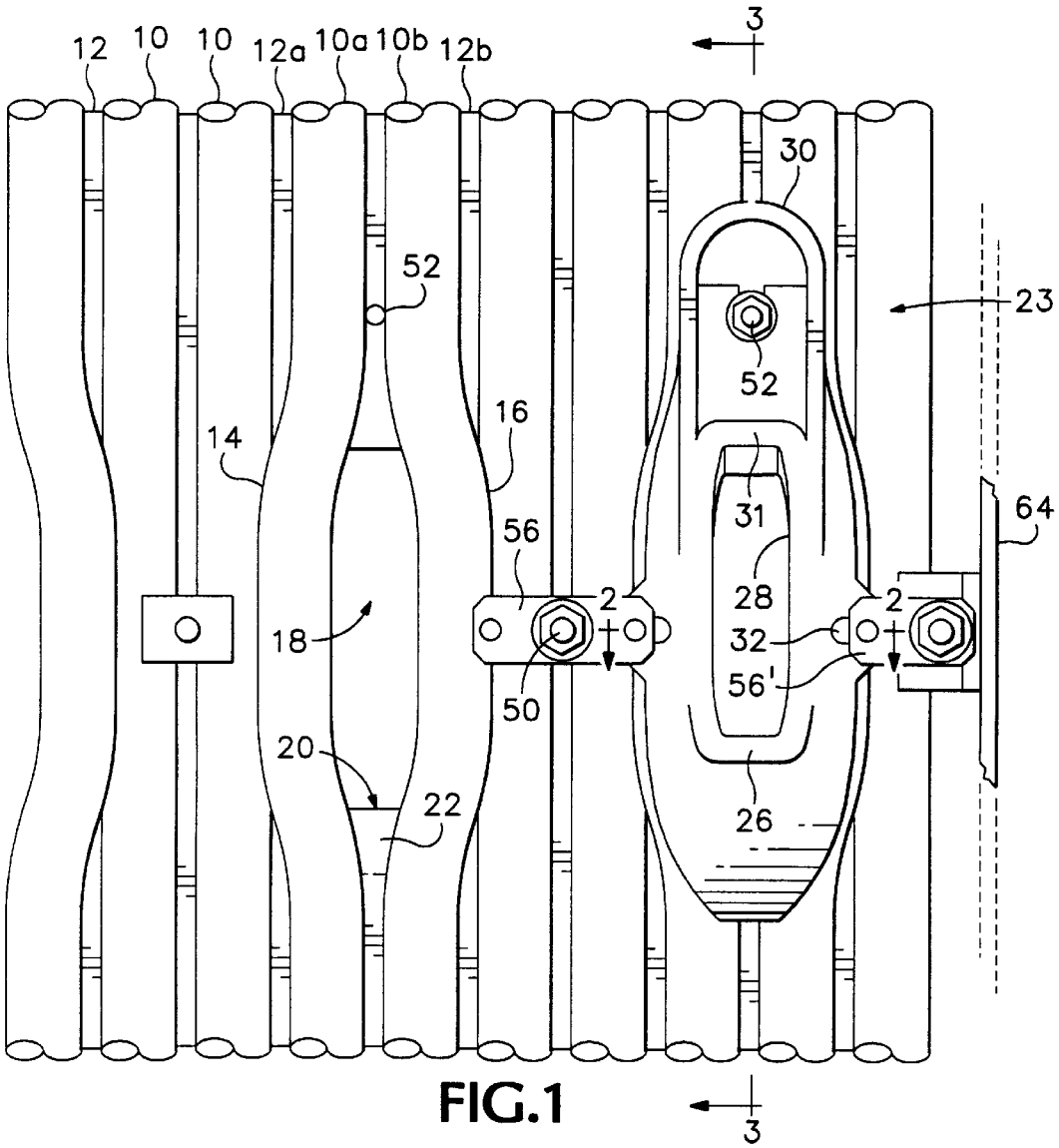
FIG. 1 is a view of two air ports in a first type of recovery boiler that employs membrane wall tubes, one air port having an air port casting in accordance with the invention installed thereon.
Figure 2:
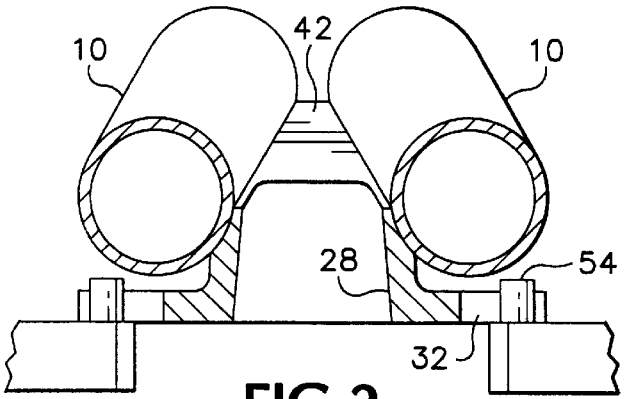
FIG. 2 is a top cut away view of an air port casting in accordance with the invention installed against the boiler tubes taken along line 2—2 of FIG. 1.

Now, referring to FIG. 3, a side sectional view of a cut away portion of an inter-tube membrane style recovery boiler, taken along line 3—3 of FIG. 1, and FIG. 2, a top cut away view of an air port casting in accordance with the invention installed against the boiler tubes taken along line 2—2 of FIG. 1, further detail of the casting and central opening 28 may be observed. The top and bottom walls of the opening in the air port casting are slanted downwardly relative to the base of the recovery boiler. Lower membrane contact pad 42 rests against the outside face 12*a* of the cooling tube membrane, at the lower end of the air port. The upper contact pad 44 rests against the outer face of the cooling tube membrane, at the upper edge of the air port. In a preferred embodiment, the air port casting extends beyond the opening defined by the absence of the membrane by at least one inch, such that at least an inch of lower contact pad 42 and an inch of upper contact pad 44 is co-extensive with the membrane 12. Accordingly, in the event of membrane 12 corroding through or being otherwise damaged, for example at area 46, the body of the air port casting is provided as an auxiliary backing. Further, the air port casting adds additional heat sink capability, to assist in transfer of heat away from the membrane. The area which in the prior art would comprise the crotch plate 22 is illustrated in phantom for comparison purposes.

Figure 6:
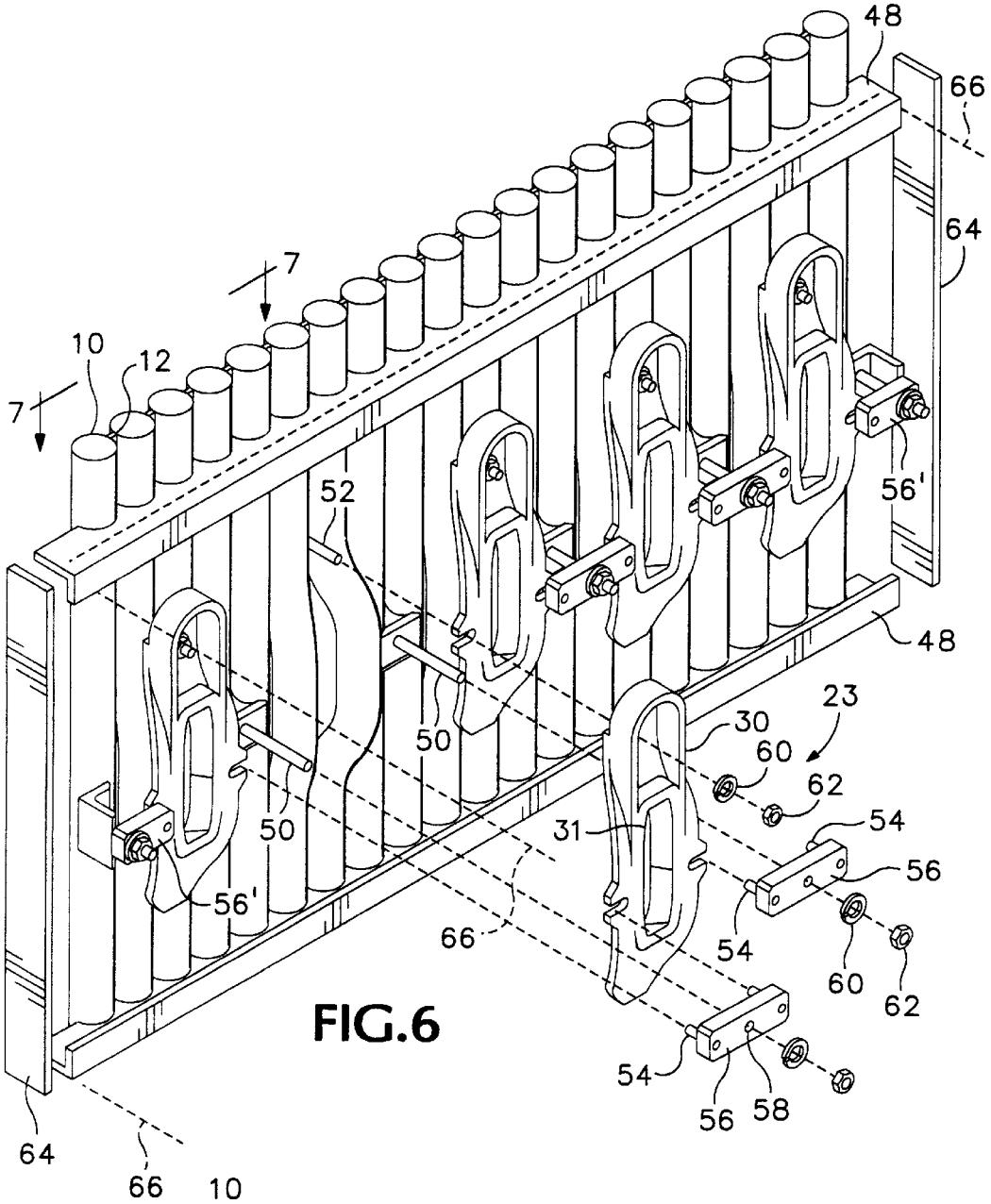
FIG. 6 is a perspective view of a section of a membrane style tube recovery boiler with air port castings according to the invention mounted thereon.
Figure 7:
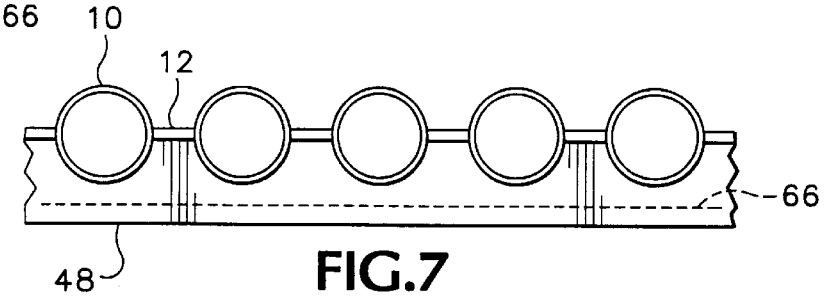
FIG. 7 is a partial sectional view of the scallop bar of FIG. 6, taken along line 7—7.

Referring now to FIG. 6, a perspective view of air port castings 23 installed in a membrane style cooling tube recovery boiler environment, the mounting of the air port castings may be better understood. As noted before, in accordance with the prior art, some membrane style cooling tube boilers employed a nozzle at each individual air port. When refurbishing this style of boiler, in accordance with the invention, it is desirable to replace the individual nozzles at each air port. The region which heretofore defined the crotch plate is removed. Upper and lower scallop bars 48 are secured (e.g. welded) above and below the air ports, to provide upper and lower seals along the cooling tubes and membranes. The scallop bar profile on one face thereof conforms to that of the tubes and membranes, while the opposite face is, for example, flat, thereby providing a flat face against which upper and lower portions of a windbox may be sealed. Referring to FIG. 7, a partial sectional view of the scallop bar of FIG. 6, taken along line 7—7, the representative shape of the scallop bar is shown in greater detail. A corresponding scallop bar for a tangent tube type boiler does not include the wider membrane matching region. Referring back to FIG. 6, left and right mounting bolts 50 are secured between adjacent tubes, for example by welding a scallop edged bracket between the tubes and securing the bolt thereto. An upper mounting bolt 52 is secured above a given air port in a manner corresponding to that employed with bolts 50.

To mount an individual air port casting over the air port, the air port casting 23 is oriented with damper guide member 30 upwardly aligned. Upper mounting bolt 52 is received within upper mounting slot 34. Left and right mounting slots 32 respectively receive the right and left mounting pins 54 of a bracket 56. Bracket 56 is suitably an elongated bar, having mounting pins 54 extending outwardly from a face of the bar at distal ends thereof. A central aperture 58 is defined in bracket 56, the aperture receiving mounting bolt 50 therethrough, whereby a lock ring 60 and nut 62 are employed to tightly secure the bracket 56 to mounting bolt 50. The air port castings is thereby held at the air port by bolt 52 and left and right brackets 56, where the respective brackets 56 also provide a mounting pin engagement for the next adjacent air ports. A sealant, for example, mastic, may suitably be applied between the casting and the cooling tubes to ensure a seal between the air port casting and the port opening.

At the edges of a given group of air ports, five such air ports comprising the group of FIG. 6, although any number of air ports could be used, flat plate members 64 are provided, defining left and right edges of a windbox seal, as well as enabling mounting of a truncated mounting bracket 56' thereto. The left and right flat plate members 64 are secured in vertical alignment against the membrane or a tube between the top and bottom scallop bars at the left and right ends thereof. The truncated mounting bracket 56' carries a single pin 54, as it is only required to engage with a single air port casting, rather than with two adjacent air port castings.

Having defined upper, lower, left and right windbox seals via scallop bars 48 and edge flanges 64, a windbox 66, shown in phantom in FIGS. 3 and 6, is suitably fitted over the group of air ports and their air port castings and sealed. In all existing boiler applications, a windbox already exists. However, often such windbox has a relatively low ceiling which would not provide sufficient room to accommodate the damper assembly and the guide portion of the port casting. In such a situation, the windbox may be modified to provide a higher ceiling area, or to eliminate the ceiling altogether, or the windbox may be replaced entirely with a windbox having sufficient room. In other boilers, a group of adjacent relatively small windboxes may suitably be replaced by a single larger windbox that spans plural air ports. In still other nozzle design boilers, the nozzles are part of the windbox. Eliminating the nozzles (to be replaced by castings) means replacing the windbox. Positive pressure is provided to the windbox by a forced draft fan, and air thereby is forced through the air port castings and the air ports into the interior of the recovery boiler. An improvement is thereby provided to the membrane or tangent cooling tube style recovery boiler that previously employed nozzles, since the air port castings are employed in a design that heretofore would not accommodate such castings, affording a more maintainable design. At maintenance time, to repair or inspect an individual air port, the upper bolt and the bolts holding the left and right brackets 56 for an individual casting can be removed, and the casting can be pulled away from the air port. Any repairs to the membrane member are then easily accomplished, and the casting itself may be replaced with a new casting. The bottom bolt problem is avoided, as the structure and mounting method of the air port casting removes the need for the bottom bolt. Furthermore, on average, about one half the hold down bolts are required. Also, if the threads are damaged on the bolts so as to prevent removal of the nuts thereon, but such to still allow the nuts to be loosened, with the mounting design of the present invention, it is only necessary to loosen the nut to a point where the mounting bar can be moved, whereupon the casting's mounting can be loosened sufficiently to enable removal.

In performing a retrofit of an inter-tube membrane style or tangent tube style boiler, the prior art nozzle members at individual air ports are permanently removed, as is the crotch plate region of the membranes at the air ports. The scallop bars, side flat plates and air port casting mounting studs and bolts are secured to the tubes and/or membrane members. The individual air port castings are then mounted to their respective air ports, and a windbox is fitted over a group of air port castings. Future inspections of the tubes and/or membranes are then much less complicated, as the air port casting is merely removed, allowing easy inspection for cracks, corrosion or other damage. Once inspection or repair is completed, either the removed casting or a new air port casting can be installed and boiler operation may be resumed.

Referring again to FIG. 3, a port cleaning rod 68 is shown inserted through the opening 28 of the air port casting. The casting suitably protects the cooling tubes 10 from damage by the cleaning rod. Frequent cleaning of the air ports is required, as the ports will tend to become clogged by molten debris from the interior of the recovery boiler, which hardens when it contacts the relatively cool surfaces of the air port. Therefore, at varying times, the cleaning rod 68 is iteratively inserted (either manually or automatically) to the air port to break away any collected material about the opening of the air port and air port casting. Once the cleaning operation is completed, the cleaning rod is either withdrawn or positioned at the bottom of the opening so as not to interfere with operation of the air port damper 70.

The air port damper 70, shown in phantom in FIG. 3, may comprise a guillotine style damper blade 72 that is slideably moveable upwardly and downwardly along axis 74. The air port casting according to the present invention represents an improvement over the prior art by suitably providing a planar support, by operation of damper guide 30 and central flat rim 26, so that the damper blade 72 has a flat guide to ride upon as it moves up and down. This enables a much simpler and also much more reliable mechanism to be employed for operating the damper blade. Also, only the mounting of the air port casting need to be considered, and no additional damper guide need be mounted to the exterior of the boiler cooling tubes to accommodate the installation of an air port damper assembly. Stop member 31 together with its engagement with the damper blade provides a seal against the forced air from entering the air port at the top of the opening in the casting, which could disrupt the desired air flow characteristics.

Figure 9:
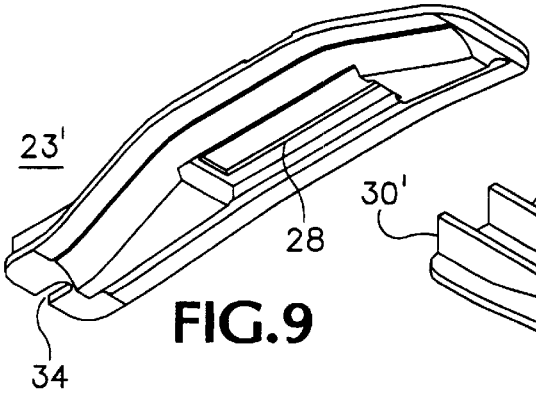
FIG. 9 is a perspective view of the inside face of a first alternative embodiment of the air port casting.
Figure 8:
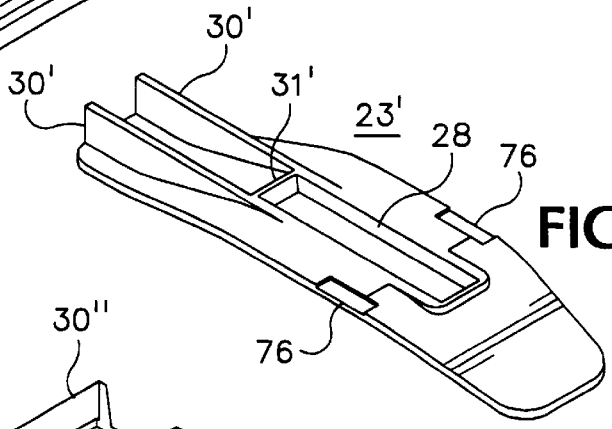
FIG. 8 is a perspective view of the outside face of a first alternative embodiment of the air port casting.

FIGS. 8 and 9 are perspective views of the outside and inside faces of a first alternative embodiment 23' of the air port casting. Air port casting 23', rather than employing mounting slots 32 in the style of the air port casting 23 of FIG. 4, has left and right shallow depressions 76 defined along a portion of the central perimeter thereof. Therefore, in mounting this style air port casting to a recovery boiler, modified brackets 56' are employed, which fit within the depressions 76. Tightening of the nut on a bolt corresponding to bolts 50 of FIG. 6 will thereby bring the bracket into secure engagement with depression 76, to hold the air port casting to the recovery boiler. An alternate damper guide member construction is employed in this embodiment, wherein the damper guide 30' is open at the top thereof, and is essentially co-extensive with the upper body of the air port casting. A stop member 31' corresponding to member 31 of FIGS. 1 and 3–5 is also provided.

Figure 11:
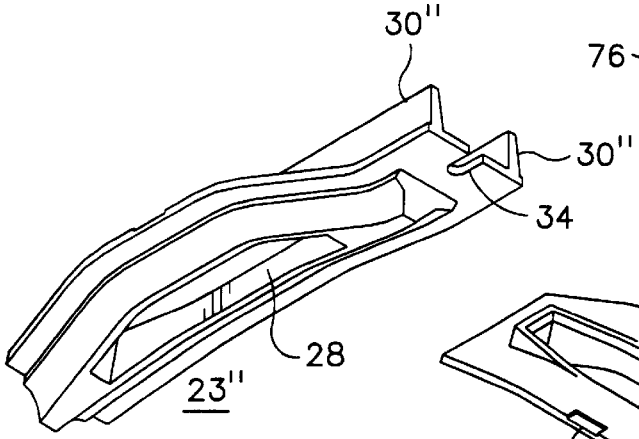
FIG. 11 is a perspective view of the inside face of a second alternative embodiment of the air port casting.
Figure 10:
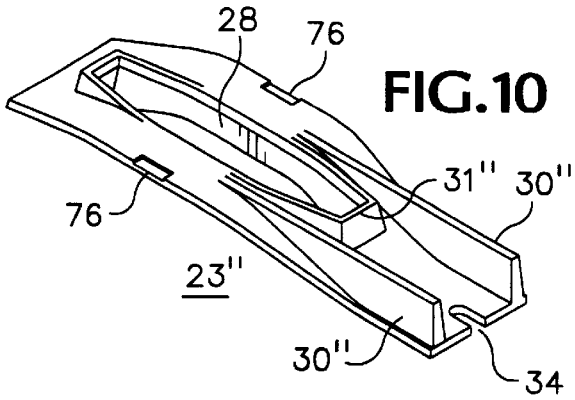
FIG. 10 is a perspective view of the outside face of a second alternative embodiment of the air port casting.

FIG. 10 and FIG. 11 are outside and inside face perspective views of a second alternative embodiment of the air port casting. This particular air port casting 23" is somewhat more curved than the other illustrated embodiments, as may be required to conform to the curvature of the cooling tubes of a particular recovery boiler. Also, the left and right legs of damper guide 30" are spaced apart somewhat more, and stop member 31" is reshaped. Other shaped and sized castings to conform to the specific application may also be provided in accordance with the invention. For example, the illustrated casting embodiments are adapted for boilers that have out-of-plane tube bends at the air ports. Other boilers that have tubes with in plane bends (the tubes are bent laterally, but do not come out of the general plane defined by the wall of tubes) and employ port castings that are relatively straight, rather than being curved.

Employing a casting at the air port in accordance with the invention provides maintenance advantages. For example, in a nozzle style boiler, after the nozzle is replaced with the casting, rather than having to repair or replace and reweld nozzles as they corrode as was required in accordance with the prior art, the casting can be unbolted and replaced as it corrodes, without requiring skilled welders and the attendant pressure vessel code welding and inspection requirements of the prior art. The air port casting provides a sacrificial corrosion surface, that is easily replaced. The air port casting suitably protects the cooling tubes from accidental damage during air port rodding. Also, since the crotch plate can be removed along with the nozzle, its potential problems are avoided. There is no longer a chance of nicking the tubes while repairing nozzles or crotch plates, and the need to x-ray welds is removed. In employing the improved casting in a boiler that previously used prior art style castings, improvements include elimination of the bottom bolt problem, reduction of the number of mounting bolts (reducing the amount of time required for maintenance and repair), providing a flat back for cooperation with a port damper assembly, and providing an extended guide for a port damper. Also, the casting employs improved metallurgy for longer life and durability. The casting is typically used at the primary air ports of a recovery boiler. However, it can also be used at secondary and tertiary air ports to provide protection from port rodding, for example.

The castings according to the invention suitably provide a sacraficial structure for the recovery boiler that is relatively easily changed or replaced as it wears out. The non-casting designs of boilers do not provide this advantage.

In a preferred embodiment of the invention, the air port castings are suitably made of stainless steel. Typical dimensions of the air port casting are approximately 21 inches in total length, opening 28 is 2.25 inches wide and 8.5 inches long, the front to back overall depth of the air port casting is 3.5 inches, while the width between the outermost edges of the air port casting near slots 32 is 7.5 inches. Of course, these values will change depending on the particular dimensions of the air ports and cooling tubes of an individual recovery boiler.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A recovery boiler having plural cooling tubes, wherein at least one air port is defined between at least two of adjacent ones of the cooling tubes, comprising:

an air port casting which adaptably fits over the opening of the air port, wherein said air port casting has an opening therein corresponding to an opening of the air port and further comprises a planar region about the opening of the air port casting, defining a flat perimeter;

a guide member formed as an integral part of the air port casting, extending away from the opening of said air port casting, said flat perimeter and said guide member defining a planar guide portion; and an air block member for preventing air flow between the opening and a region adjacent said guide member.

2. A recovery boiler having plural cooling tubes, wherein at least one air port is defined between at least two of adjacent ones of the cooling tubes, comprising:

an air port casting which adaptably fits over the opening of the air port, wherein said air port casting has an opening therein corresponding to an opening of the air port and further comprises a planar region about the opening of the air port casting, defining a flat perimeter; and a guide member formed as an integral part of the air port casting, extending away from the opening of said air port casting, said flat perimeter and said guide member defining a planar guide portion, wherein said guide member comprises a first rail member extending out of a body of the air port casting.

3. A recovery boiler according to claim 2 further comprising a second rail member extending out of the body of the air port casting.

4. A recovery boiler according to claim 3 wherein said first and second rail members are substantially parallel to one another.

5. A recovery boiler according to claim 3 wherein said first and second rail members are defined on a face of the air port casting away from the opening of the air port.

6. A recovery boiler according to claim 3 wherein said first and second rail members are joined together at one end thereof.

7. A recovery boiler having plural cooling tubes, wherein at least one air port is defined between at least two of adjacent ones of the cooling tubes, comprising:

an air port casting which adaptably fits over the opening of the air port, wherein said air port casting has an opening therein corresponding to an opening of the air port and further comprises a planar region about the opening of the air port casting, defining a flat perimeter;

a guide member formed as an integral part of the air port casting, extending away from the opening of said air port casting, said flat perimeter and said guide member defining a planar guide portion; and first, second and third mounting members secured to the cooling tubes and membrane members adjacent left, right and top sides of the air port, wherein said air port casting consists of first, second and third mounting member receiving portions at the top, left and right sides of the air port casting, for receiving said first, second and third mounting members therein, thereby securing the air port casting to the recovery boiler in absence of a bottom bolt secured to the air port casting.

8. An air port casting for placement at an air port of a recovery boiler, the recovery boiler having plural adjacent cooling tubes, where the air port is defined by bending of at least two adjacent cooling tubes away from one another, comprising:

a body member having an opening defined therein corresponding to at least a portion of the air port and including a planar region about the opening;

a guide member extending away from the opening in said body member and providing an extension of said planar region, thereby providing a guide for a damper or the like which alternatively covers or does not cover the opening of said body member; and a block member adjacent the opening in said body member for restricting air flow from said opening past said block member toward said guide member.

9. A method for retrofitting an inter-tube membrane style recovery boiler having at least one air port and at least one crotch plate adjacent the air port, the method comprising the steps of:

removing the at least one crotch plate;

providing an air port casting adjacent the at least one air port.

10. The method according to claim 9 further comprising the step of placing a windbox over the at least one air port and air port casting.

11. In a recovery boiler having plural cooling tubes, wherein ones of adjacent cooling tubes have a membrane member therebetween, and wherein at least one air port is defined between two adjacent cooling tubes by spreading the two tubes apart and removing the membrane member in the spread apart region, an improved air port casting comprising:

first and second membrane member contact pads at upper and lower portions of the air port casting for placement against the membrane at an outer side thereof relative to the interior of the recovery boiler, said first and second membrane member contact pads being coextensive with the membrane member along a vertical region of the membrane member.

12. The improved air port casting according to claim 11, wherein the vertical region along which said contact pads are co-extensive with the membrane member is at least 1 inch in length.

13. A recovery boiler having plural air ports defined therein, comprising:

a mounting member defined between a first and a second adjacent ones of said plural air ports; and first and second air port castings for placement at the first and second air ports, wherein said mounting member is employed to secure both said first and said second air port castings at the first and second air ports, and wherein said mounting member comprises a mounting stud secured to said recovery boiler and wherein a bracket member mounts in fixed relation to said mounting stud, said bracket member comprising first and second engaging pins for engaging and securing said first and second air port castings.

14. A recovery boiler according to claim 13 wherein said first and second air port castings further comprise receiving apertures for receiving said first and second engaging pins therein for effecting the engagement and securing of the air port castings.

15. A recovery boiler having plural air ports defined therein, comprising:

a first mounting member defined between a first and a second adjacent ones of said plural air ports;

a second mounting member positioned above ones of the air ports; and first and second air port castings for placement at the first and second air ports, wherein said first mounting member is employed to secure both said first and said second air port castings at the first and second air ports, and wherein said second mounting member is for engaging a top portion of a an air port casting at a selected one air port.

16. A recovery boiler according to claim 15 wherein said air port casting comprises a receiving portion for receiving said second mounting member therein for further securing the air port casting to the air port.

17. A method of altering a recovery boiler, wherein said recovery boiler employs at least one nozzle at an air port thereof, comprising the steps of:

removing the at least one nozzle from the air port; and placing a port casting against an opening of the air port.

18. The method according to claim 17 further comprising the step of removing at least one crotch plate from an area adjacent the air port prior to placing the port casting against the air port.

* * * * *